United States Patent [19]

Mohr et al.

[11] Patent Number: 4,613,267

[45] Date of Patent: Sep. 23, 1986

[54] DEVICE FOR THE INTERMEDIATE STACKING OF MATERIAL THAT IS TO BE CUT

[76] Inventors: Karl Mohr, Hattersheimer Strasse 11; Wolfgang Mohr, Hundshager Weg 42, both of D-6238 Hofheim/Taunus, Fed. Rep. of Germany

[21] Appl. No.: 679,745

[22] Filed: Dec. 10, 1984

[30] Foreign Application Priority Data

Dec. 14, 1983 [DE] Fed. Rep. of Germany ..... 8335816

[51] Int. Cl.[4] ..... B65G 57/09; B65G 59/02

[52] U.S. Cl. ..... 414/37; 414/42; 414/80; 414/114; 414/118

[58] Field of Search ..... 414/37, 42, 76, 80, 414/101, 102, 114, 118, 119

[56] References Cited

U.S. PATENT DOCUMENTS

| | | | |
|---|---|---|---|
| Re. 30,742 | 9/1981 | Weier | 414/119 |
| 674,262 | 5/1901 | Duncan et al. | 414/80 X |
| 1,225,523 | 5/1917 | Surles | 414/42 |
| 3,146,897 | 9/1964 | Curtenius et al. | 414/114 |
| 3,363,781 | 1/1968 | Magnetti | 414/95 |
| 3,398,841 | 8/1968 | Mohr | 414/114 |
| 3,897,877 | 8/1975 | Vandermeer et al. | 414/42 X |

FOREIGN PATENT DOCUMENTS

| | | | |
|---|---|---|---|
| 57-166229 | 10/1982 | Japan | 414/119 |

*Primary Examiner*—Leslie J. Paperner
*Attorney, Agent, or Firm*—Max Fogiel

[57] ABSTRACT

The invention concerns a device for the intermediate stacking of material that is to be cut, wherein the material is supplied from the work table of one work station, especially a jolting table, to a fork lift, on which the material is made into component stacks with boards positioned between them, and thence to another work station, especially the cutting table of a cutting machine.

The object of the invention is to provide a device that makes it possible to stack materials that are to be cut without the component stacks getting displaced.

This object is attained in accordance with the invention in that movable stops (13) are positioned below the level of the supporting surfaces (20, 21) of the work tables (10, 12), whereby the stops, when they are in, are outside of the stroke space that occurs when the boards (*7a, 7b, 7c, 7d, 7e*) are raised and lowered, whereby the stops, when they are out, engage the stroke space, and whereby the supporting surface (19) of the board (*7e*) delineates a plane in conjunction with the supporting surfaces of the work tables when the stops are out and a board (*7e*) is laid on them.

8 Claims, 1 Drawing Figure

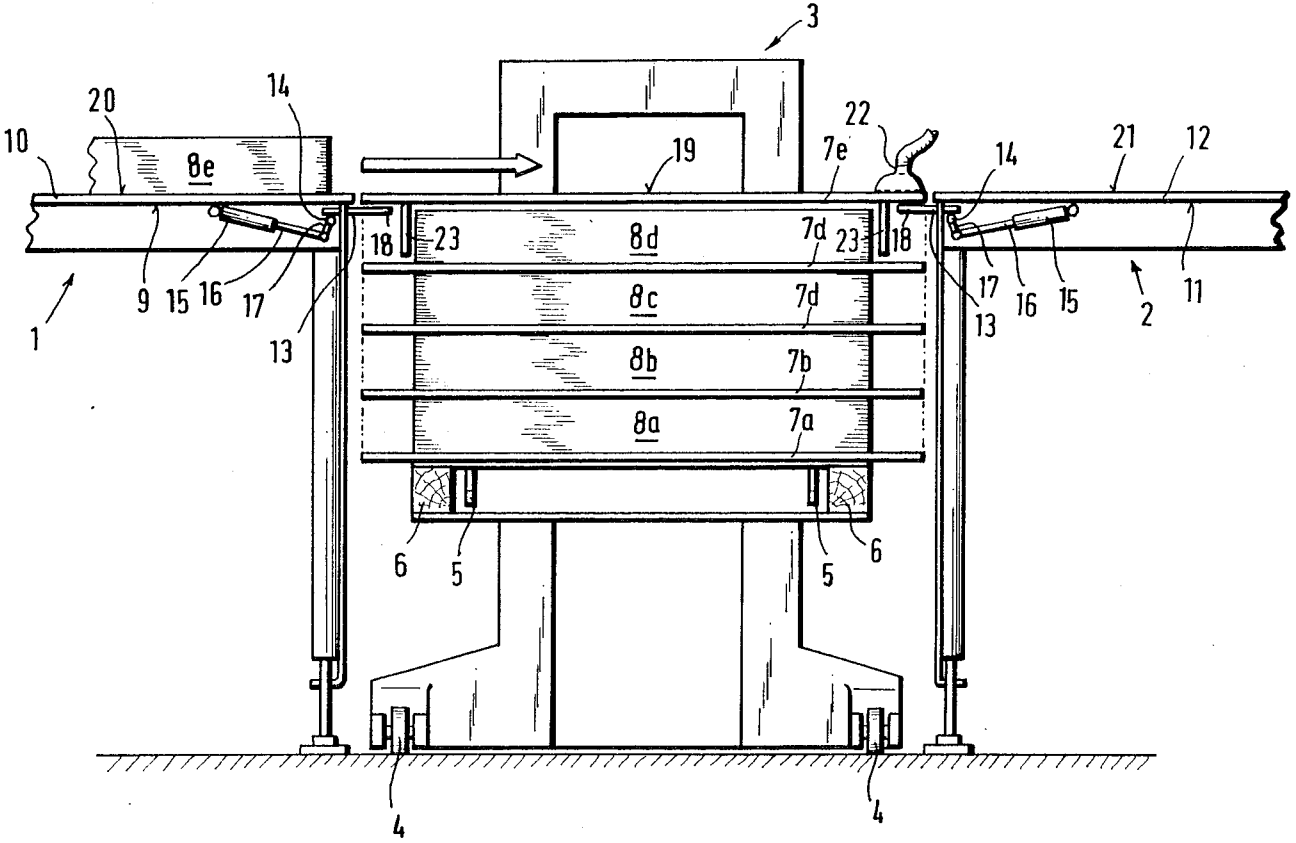
1
2
3
4
5
6
7a
7b
7d
7e
8a
8b
8c
8d
8e
9
10
11
12
13
14
15
16
17
18
19
20
21
22
23

DEVICE FOR THE INTERMEDIATE STACKING OF MATERIAL THAT IS TO BE CUT

The invention concerns a device for the intermediate stacking of material that is to be cut, wherein the material is supplied from the work table of one work station, especially a jolting table, to a fork lift, on which the material is made into component stacks with boards positioned between them, and thence to another work station, especially the cutting table of a cutting machine.

A device of this type is known from German Patent No. 1 244 711. Before being cut, the material is jolted on a jolting table to precisely align the individual sheets of paper with respect to one another. Subsequent to jolting, the material is stacked intermediately on a fork lift. Subsidiary stacks of material are located one above another on the fork lift with boards positioned between them. Shifting the component stacks from the jolting table to the boards and from the boards to the cutting table is facilitated in that the boards generate air cushions, each board being provided with an air supply and with air nozzles on the surface toward the component stack that rests on the board.

There is, however, a drawback to a device of this type in that, when the individual sheets that make up a component stack are not stacked level, the air-cushion generating board that rests on top of the stack can tilt. The board will accordingly not be reliably flush with the supporting surfaces of the work tables. When a component stack is loaded on or unloaded from the uppermost board, the component stack just below the board will get displaced and cannot be cut precisely.

The object of the invention is to provide a device that makes it possible to stack materials that are to be cut without the component stacks getting displaced.

This object is attained in accordance with the invention in that movable stops are positioned below the level of the supporting surfaces of the work tables, whereby the stops, when they are in, are outside of the stroke space that occurs when the boards are raised and lowered, whereby the stops, when they are out, engage the stroke space, and whereby the supporting surface of the board delineates a plane in conjunction with the supporting surfaces of the work tables when the stops are out and a board is laid on them.

When the fork lift has been loaded, the fork is lowered until any shipping pallet that rests on it or any component stack that has already been laid off or both is or are below the stops. The stops are then moved out and the board laid on them. The stops secure the board in this position, in which the supporting surface of the board delineates a plane in conjunction with the supporting surfaces of the work tables. The component stack being laid off is shifted onto the board and the lift fork raised until the uppermost board, with the component stack laid off, relieves the stops. The stops are then moved in, so that they are outside of the stroke space that occurs when the boards are raised and lowered, the fork is lowered until the upper surface of the last component stack to be laid off is below the stops, leaving a space between it and the bottom of the next board to be laid on. Finally, the stops that will accommodate the next board along with another component stack on top of it are moved out.

To remove the stacks, the fork is raised until the stops below the board supporting the uppermost component stack can be moved. The fork is then lowered until the uppermost board lies on the stops, leaving a space between the bottom of the uppermost board and the top of the component stack that is being kept ready beneath it or, in the final stage of operations, leaving a space between the bottom of the uppermost board and the top of the shipping pallet. The ready component stack is then supplied to the second work station, the board extracted, and the stops moved in. The fork lift then lifts the next component stack.

When they are in the out position, accordingly, the function of the stops in accordance with the invention is to ensure that the board resting on them is level and that the supporting surface of the board is flush with the supporting surfaces of the work tables. Whereas it is conventionally the fork lift that supports both the component stacks and the boards positioned between them, this function is assumed in accordance with the invention for the uppermost board and for the component stack resting on it by the stops. Separating the uppermost board from the rest of the stack while a component stack is being loaded or unloaded prevents the component stack just below the uppermost board from getting displaced.

The stops can be attached not only to the work stations but also to the fork lift. The stops are preferably flaps with one end fastened, in such a way that it can pivot, to the bottom of the work slabs and the other, free, end supporting the board. Positioning the flaps at the bottom of the work slabs saves a lot of space especially with respect to the fork lift.

Drive mechanisms, especially hydraulically powered cylinders, should be positioned on the bottom of the work slabs to pivot the flaps.

To ensure the stability of the board in relation to the supporting surfaces of the work slabs several flaps should be distributed along the board, perpendicular that is to the direction in which the component stack is shifted onto the board.

It is however also possible for the stops to be positioned, not in such a way that they can pivot but in such a way that they can slide, on the bottom of the work slabs. In this case, arbor-like projections can engage either the bottom of the board or recesses in the board when the stops are out and maintain it flush with the work slabs. The projections will also be moved in and out by drive mechanisms.

It is, finally, possible to position the stops in such a way that they can either pivot or slide, not on the work stations but on the fork lift.

It is an advantage for the boards to have standards at the bottom that are of the same length and longer than the component stack below the board is high. Boards with standards are indicated when the stack is composed of light-weight, high-quality sheets. In this case the weight of all the component stacks will not rest on lowest component stack but the boards will rest on the other boards.

To facilitate shifting the component stacks the boards should be air-cushion generating boards with inlets and outlets to blow air through.

It is an advantage for the fork lift to have wheels to travel on. Thus, the fork lift can leave the vicinity of operations and take on new material even while the component stack on a board is being supplied to the next work station with the stops out or while component stacks are being supplied from one work station to another with a board.

Further characteristics of the invention are illustrated in the FIGURE in the drawing. The FIGURE is a longitudinal section through the device.

A fork lift 3 is positioned between an incompletely illustrated jolting table 1 and the incompletely illustrated cutting table 2 of a paper-cutting machine. Fork lift 3 has wheels 4 to travel on at the bottom. The partly raised fork 5 of fork lift 3 projects through a pallet 6 on which the material that is to be cut is positioned in component stacks 8*a*–8*d* with air-cushion generating boards 7*a*–7*e* between them.

Several flaps 13 are positioned perpendicular to the plane of projection in such a way that they can pivot around joints 14 on the bottom 9 of the work slab 10 of jolting table 1 and on the bottom 11 of the work slab 12 of cutting table 2. The piston rods 16 of hydraulically powered cylinders 15 also positioned on bottoms 9 and 11 engage elbows 17 on flaps 13 for this purpose.

Flaps 13 are positioned on bottoms 9 and 11 and dimensioned in relation to supports 18 that are positioned on their free ends such that a board 7*e* can be laid over supports 18 when the flaps are pivoted out as illustrated in the FIGURE, supporting surface 19 delineating a plane in conjunction with the supporting surfaces 20 and 21 of work slabs 10 and 12. In the position illustrated in the FIGURE, the air intake, not illustrated, in board 7*e* communicates with a schematically illustrated air bell 22. Air bell 22 pumps a current of air into board 7*e* and thence through air outlets in the top of the board. The film of air that forms over board 7*e* facilitates shifting a component stack 8*e* from supporting surface 20 to board 7*e*.

When flaps 13 are out, the fork 5 of fork lift 3 is lowered far enough to leave a space between the bottom of board 7*e* and the top of component stack 8*d*. This ensures that the individual sheets at the top of component stack will not be carried along when the stack is shifted onto board 7*e*.

Once component stack 8*e* is on board 7*e*, the fork 5 of fork lift 3 is raised slightly to relieve flaps 13. In contrast to air-cushion generating boards 7*a*–7*d*, board 7*e* comes to rest with its four standards 23 on top of board 7*d* without contacting the component stack 8*d* on board 7*d*. The other air-cushion generating boards 7*a*–7*d* on the other hand do not have any standards 23, board 7*b* resting directly on component stack 8*a*, board 7*c* directly on component stack 8*b*, and board 7*d* directly on component stack 8*c*. It is however also possible for all the boards either to have or not to have standards 23.

Once flaps 13 have been relieved, they are pivoted back by hydraulically powered members 15 until they are outside of the stroke space that occurs when air-cushion generating boards 7*a*–7*e* are lifted and lowered (the contour of the space is represented by the broken line).

The introduction of further component stacks into the fork lift and the removal of the component stacks from the fork lift have been described in the foregoing.

We claim:

1. Apparatus for intermediate stacking of material that is to be cut, comprising: a first work station with a jolting table; a fork lift for carrying the material in subdivided stacks with boards between the subdivided stacks; a second work station, said fork lift being located between said first work station and said second station; a cutting machine with a cutting table at said second station; movable stops positioned below supporting surfaces of said tables; said stops having a first position in which said stops are clear of a path of motion of said boards when said boards are raised and lowered; said stops having a second position in which said stops extend into said path and support an uppermost board, said board having a surface defining a plane together with said supporting surfaces of said tables when said stops are in said second position, said stops being located on opposite sides of said board and reach underneath said board on said opposite sides to form said plane and lift said board from the uppermost subdivided stack, said stops serving only to support said board without resisting any forces occurring in said plane aside from frictional forces between said board and said stops; said boards comprising air boards to avoid forces in directions in said plane, so that a subdivided stack on said board supported on one table can be moved unobstructed in said plane toward the other table.

2. Apparatus as defined in claim 1, wherein said stops comprise flaps having one end fastened so that said flaps can pivot to the bottom of said tables, said flaps having a free end supporting said board.

3. Apparatus as defined in claim 2, including drive means having hydraulic-powered cylinders positioned on the bottom of said work tables for pivoting said flaps.

4. Apparatus as defined in claim 1, wherein said stops comprise a plurality of flaps distributed along said board.

5. Apparatus as defined in claim 1, wherein said stops are positioned for sliding on the bottom of said tables.

6. Apparatus as defined in claim 1, wherein said boards have standards at the bottom, said standards having a length equal substantially to the height of said subdivided stacks below said board.

7. Apparatus as defined in claim 1, wherein said boards have standards at the bottom, said standards having a length which is substantially longer than the height of said subdivided stacks below said board.

8. Apparatus as defined in claim 1, wherein said fork lift has wheels for being transported thereon.

* * * * *